US005413514A

United States Patent [19]

Milligan

[11] Patent Number: 5,413,514

[45] Date of Patent: May 9, 1995

[54] RECOVERABLE AERIAL TOY

[75] Inventor: Tim V. Milligan, Canon City, Colo.

[73] Assignee: Centuri Corporation, Penrose, Colo.

[21] Appl. No.: 69,175

[22] Filed: May 28, 1993

[51] Int. Cl.[6] ..... A63H 27/127

[52] U.S. Cl. ..... 446/36; 446/211; 244/138 A

[58] Field of Search ..... 446/34, 2, 36–39, 446/211, 217–218; 102/348, 387; 244/138 R, 138 A, 139

[56] References Cited

U.S. PATENT DOCUMENTS

| | | | |
|---|---|---|---|
| 2,044,819 | 1/1936 | Taylor | 446/36 |
| 2,400,175 | 5/1946 | Suyat | 46/86 |
| 2,684,213 | 7/1954 | Robert et al. | 244/8 |
| 2,978,211 | 11/1961 | Wannlund et al. | 244/138 A |
| 3,098,445 | 7/1963 | Jackson | 102/49 |
| 3,188,768 | 6/1965 | Boswell | 46/75 |
| 3,795,194 | 3/1974 | Kendrick | 102/34.1 |
| 3,888,178 | 6/1975 | Senoski | 102/34.1 |
| 3,903,801 | 10/1975 | Senoski | 446/36 |
| 4,295,290 | 10/1981 | Boswell . | |
| 4,687,455 | 8/1987 | Sculatti | 446/52 |
| 4,913,675 | 4/1990 | Wilcox | 446/36 |

FOREIGN PATENT DOCUMENTS 66150 10/1913 U.S.S.R. .

*Primary Examiner*—Robert A. Hafer
*Assistant Examiner*—Jeffrey D. Carlson
*Attorney, Agent, or Firm*—Lahive & Cockfield

[57] ABSTRACT

A recoverable aerial toy having a gyro-rotating recovery system that includes a main body which extends along a longitudinal axis, a rotor hub element mounted on the main body and rotatable relative thereto about the longitudinal axis, and a plurality of rotor blades. The rotor blades are hingedly coupled to the rotor hub element for rotation therewith about the axis and for hinged movement relative thereto between a closed position and an open position, such that the rotor blades extend along the longitudinal axis when disposed in the closed position and extend radially relative to the axis and outward from the main body when disposed in the open position. The aerial toy apparatus further includes a releasable retaining element that is carried on the main body and movable relative thereto between a hold position and a release position, for selectively holding the rotor blades in the closed position when the retaining element is disposed in the hold position, and for releasing the blades into the open position when the retaining element is disposed in the release position.

12 Claims, 4 Drawing Sheets

RECOVERABLE AERIAL TOY

BACKGROUND OF THE INVENTION

This invention relates generally to the field of model rockets and like projectiles. More particularly, it pertains to model rockets having a gyro-rotating recovery system that allows recovery and reuse of the rocket. As used herein, model rocket includes aerial toys, model toy rockets, and model projectiles.

Modern space travel and exploration have engendered considerable interest in flight and, in particular, rockets. Today, a variety of model rockets are available, most of which are designed for repeated use, and therefore employ various recovery systems that enable the user to retrieve the rocket with minimal damage.

Known recovery systems used to safeguard model rockets from 'hard' landings include parachutes and gyro-rotating assemblies. In recovery systems incorporating parachutes, the parachute can be contained within the body of the model rocket during launch and ascent. An ejection charge, contained within a solid fuel propellant charge, can separate the nose cone from the rocket body, thereby ejecting the parachute. The parachute unfurls and slows the rocket's descent.

Problems exist with regard to the parachute style recovery system. The recovery system is subject to the uncertainties of the wind during descent. Thus, the user never knows where or how far from the launch site the rocket will land. This is problematic if the rocket is used in a moderately populated environment or near water.

Another problem with some prior parachute-style recovery systems is that the rocket fuselage that houses the parachute can separate upon descent, which makes it difficult to retrieve all the rocket parts for reuse.

Prior gyro-rotating recovery systems also have drawbacks. First, the recovery systems fail to provide a one-piece recovery unit. Second, the recovery systems add unwanted body mass to the model rocket. One prior gyro-rotating assembly is disclosed in U.S. Pat. No. 4,295,290 of Boswell, where a toy projectile has a lower stage which separates from an upper stage to release foil members. Each stage descends to the ground separately. The released foil members provide a gyro-rotating recovery system for a helicopter-like descent of the upper stage only, making it difficult to retrieve all the rocket parts for reuse.

U.S. Pat. No. 3,903,801 of Senoski discloses a gyro-rotating system in which a model rocket has a body fuselage that houses a set of rotor blades. A nose cone caps one end of the body fuselage and a base that mounts a solid fuel propellant caps the other end. The rotor blades are attached to the nose cone of the rocket. An ejection charge contained within the fuel propellant separates the nose cone from the body fuselage, thereby releasing the rotor blades. The nose cone is secured to the rocket fuselage by a tether.

These prior gyro-rotating recovery systems exhibit little improvement over the parachute style recovery system. The Boswell rocket assembly appears to make it difficult to retrieve the entire rocket assembly for reuse. The rocket fuselage that houses the rotor blades, as described in the Senoski patent, adds unwanted body mass to the assembly, making the rocket difficult to propel during ascent, and causing the rocket to fall faster during descent.

As the foregoing and other prior model rockets have proven less than optimal, an object of this invention is to provide a model rocket with a reliable recovery system to enhance repeated use of the rocket.

Another object of the invention is to provide a rocket assembly that does not disassemble during flight.

Still another object of the invention is to provide a relatively low-cost model rocket that is easy to assemble and to launch.

Other general and more specific objects of the invention will in part be obvious and will in part be evident from the drawings and description which follow.

SUMMARY OF THE INVENTION

The invention attains the foregoing and other objects with a recoverable model rocket having a gyro-rotating recovery system. The model rocket includes a main body which extends along a longitudinal axis, a rotor hub element mounted on the main body and rotatable relative thereto about the longitudinal axis, and a plurality of rotor blades. The rotor blades are hingedly coupled to the rotor hub element for rotation therewith about the axis and for hinged movement relative thereto between a closed position and an open position. In a preferred embodiment, the rotor blades extend along the longitudinal axis when disposed in the closed position, and extend radially relative to the axis and outward from the main body when disposed in the open position.

The model rocket according to the invention further includes a releasable retaining element that is carried on the main body. The retaining element is movable relative to the main body between a hold position and a release position, for selectively holding the rotor blades in the closed position when the retaining element is disposed in the hold position, and for releasing the blades into the open position when the retaining element is disposed in the release position.

In one aspect of the invention, the aerial toy further includes a biasing element for biasing the rotor blades into the open position.

According to another aspect of the invention, the releasable retaining element includes a sliding element for selectively holding the blades in the closed position when the sliding element is disposed in the hold position, and for releasing the blades into the open position when the retaining element is disposed in the release position. An actuating element is provided which couples to the sliding element for moving the sliding element from the hold position to the release position. The sliding element of the invention can be an external slide element. The actuating element of the invention can include the rocket nose cone.

According to another aspect, the actuating element, which moves the sliding element from the hold position to the release position, moves by means of either gravity, gas pressure, or a combination of these actions. Moreover, the releasable retaining element moves axially between the hold position and the release position.

According to further aspects, the aerial toy apparatus includes an engagement element for engaging the releasable retaining element to the main body. The engagement element of the invention can be a slide stop element.

The model rocket, in one preferred embodiment of the invention, is arranged such that the main body has a forward nose end and mounts the rotor hub element at a location distal from the nose end. The rotor blade has a tip end and a base end distal thereto, and is coupled to the rotor hub element such that the hub element and the blades are arranged for disposing the blade tip ends proximal to the nose end when the rotor blades are in the closed position. The rotor hub element includes a rotor hub and a plurality of rotor mounts hingedly mounted to the rotor hub, each of which has a blade-receiving portion for removably and replaceably securing the rotor blades thereto.

According to another embodiment of the invention, when the rotor blades are disposed in the open position, the external slide element engages with the slide stop element.

These structural features of the model rocket, and other features set forth below, attain a rocket that is relatively high performing, low-cost, and lightweight. The rocket avoids unwanted body mass by eliminating the need for a massive body fuselage that retains the rotor blades in the closed position. Further, the design of the present invention attains a model rocket structure that remains securely assembled during flight, thereby enhancing repeated use of the rocket.

BRIEF DESCRIPTION OF THE DRAWINGS

The foregoing and other aspects of the invention can be more fully understood from the following description and the accompanying drawings, in which.

DESCRIPTION OF ILLUSTRATED EMBODIMENT

Figure 1:
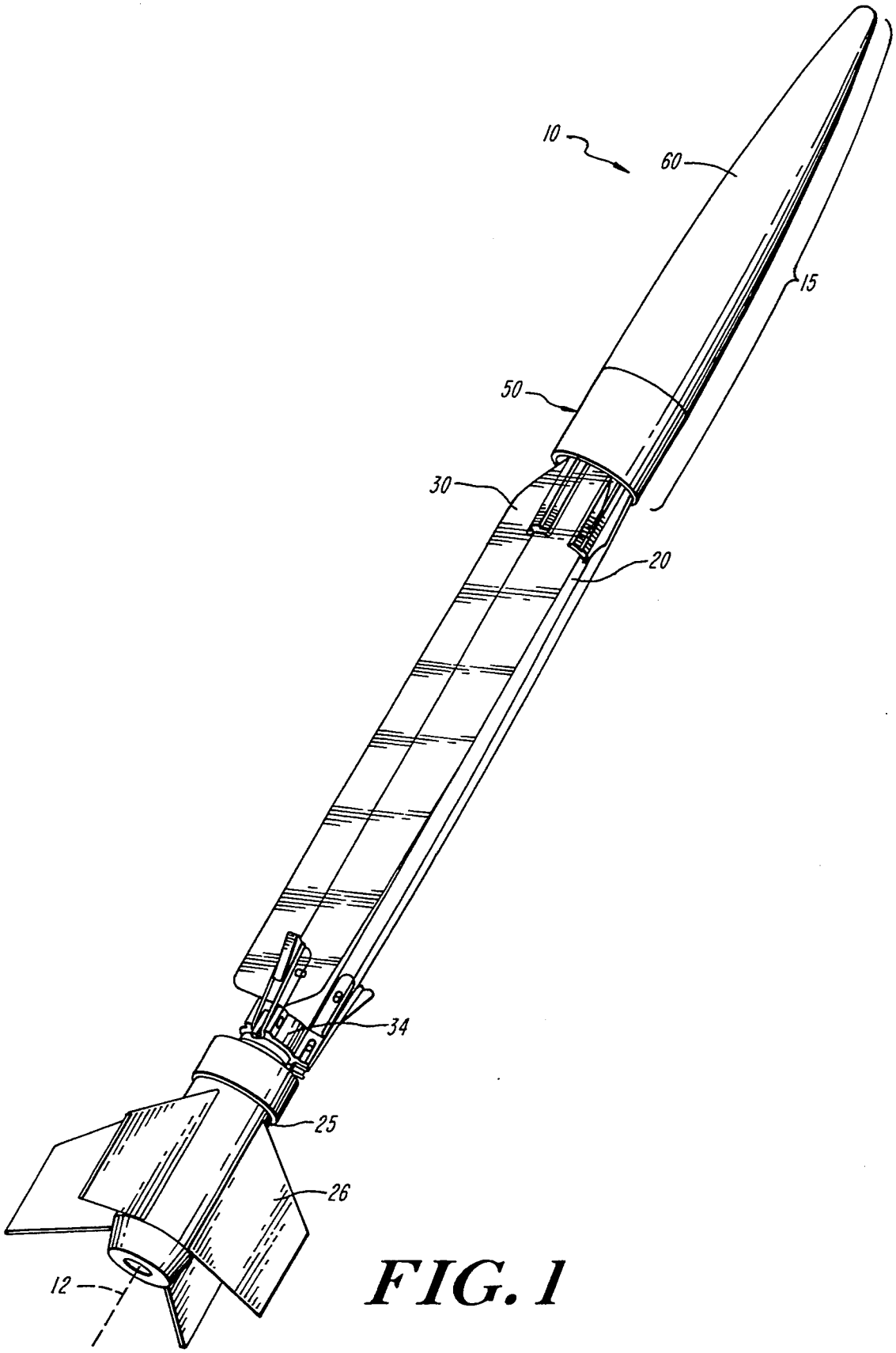
FIG. 1 is a side view of the toy projectile according to a preferred embodiment of the invention.

FIG. 1 depicts a preferred embodiment of a model rocket 10 that includes a nose cone or releasable retaining assembly 15 having a nose cone 60 and an external slide element 50. The nose cone assembly mounts to a forward end of a main body 20, and a tail assembly 25 mounts to an end opposite the forward end. A rotor hub assembly 34 coaxially seats over the main body 20, and mounts rotor blades 30. The external slide element 50 of the nose cone assembly 15 secures the rotor blades 30 along the main body 20.

The tail assembly 25 mounts a rocket engine and igniter system for providing the model rocket 10 with sufficient loft. The tail assembly is of a type similar to that described in the commonly assigned U.S. Pat. No. 5,267,885 filed on Aug. 20, 1991, which is incorporated herein by reference. The rocket engine is generally an explosive composition that burns at a predetermined rate, as is known in the art.

The illustrated main body 20 is a hollow cylindrical tube having an inner-lumen 36 (see FIG. 3), and extends along a longitudinal axis 12. The nose cone assembly 15 can have any substantially aerodynamic configuration, such as the conical shape shown.

Figure 2:
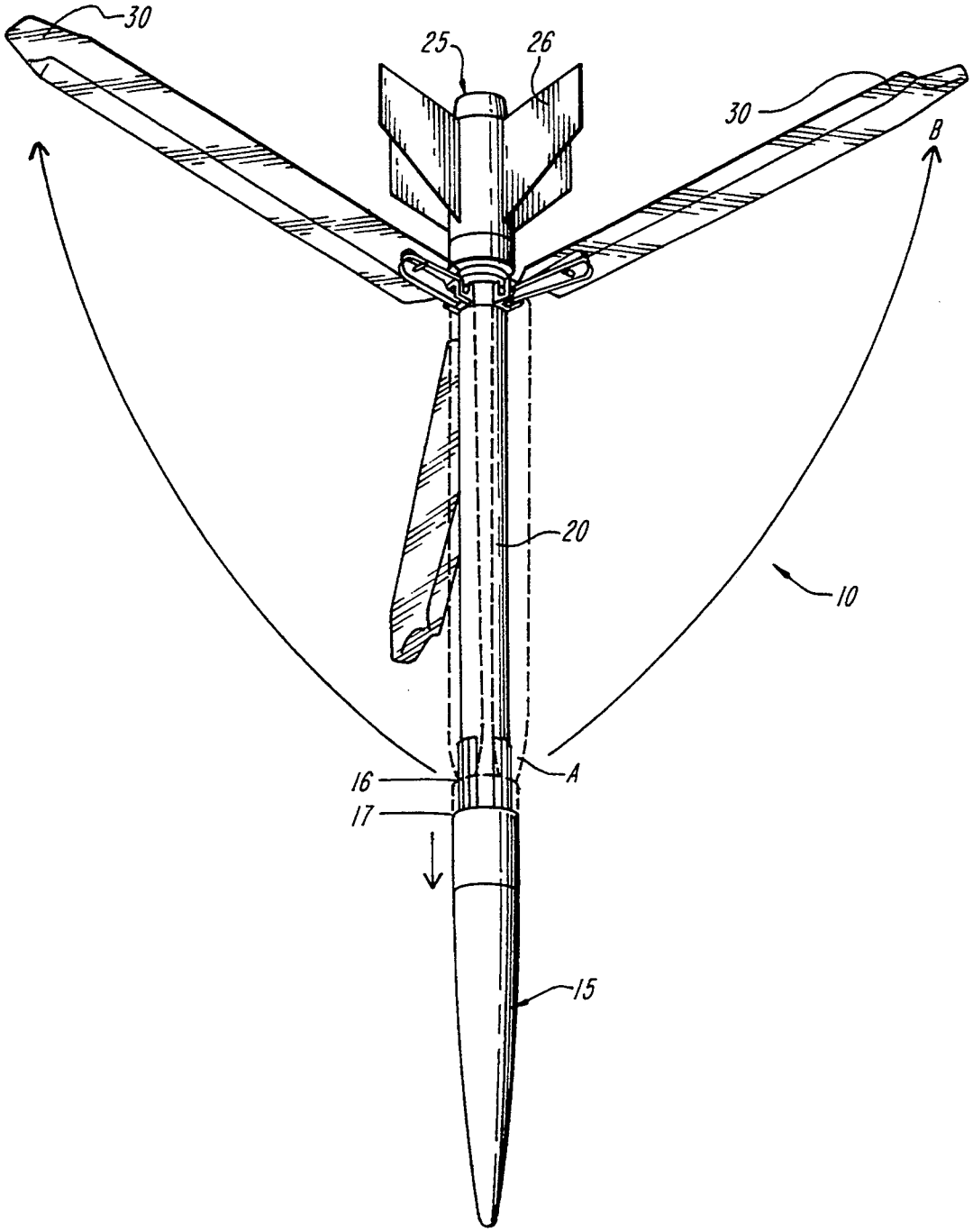
FIG. 2 is a side view of the toy projectile of FIG. 1 with the rotor blades disposed in an open configuration.

FIGS. 1 and 2 show the model rocket 10 with the rotor blades 30 disposed in a closed position and an open position, respectively. Referring to FIG. 2, the nose cone assembly 15 moves axially between a hold position 16 (shown in phantom), and a release position 17, as indicated by the solid vertical arrow. In the closed position A (shown in phantom in FIG. 2), the nose cone assembly 15 is disposed in the hold position 16, retaining the rotor blades 30 alongside the main body 20. In the open position B, the rotor blades extend radially outward from the main body 20, substantially transverse to the longitudinal axis 12, as shown. The large curved arrows represent the movement of the rotor blades 30 between the closed position A and the open position B.

The rotor blades 30 and rotor hub 34 freely rotate together about the main body 20. When the rotor blades 30 extend radially from the main body 20, aerodynamic force applied by on-rushing air applies a force perpendicular to the blades 30, causing the blades 30 to rotate. The rotating blades 30 slow the rocket's descent.

Figure 3:
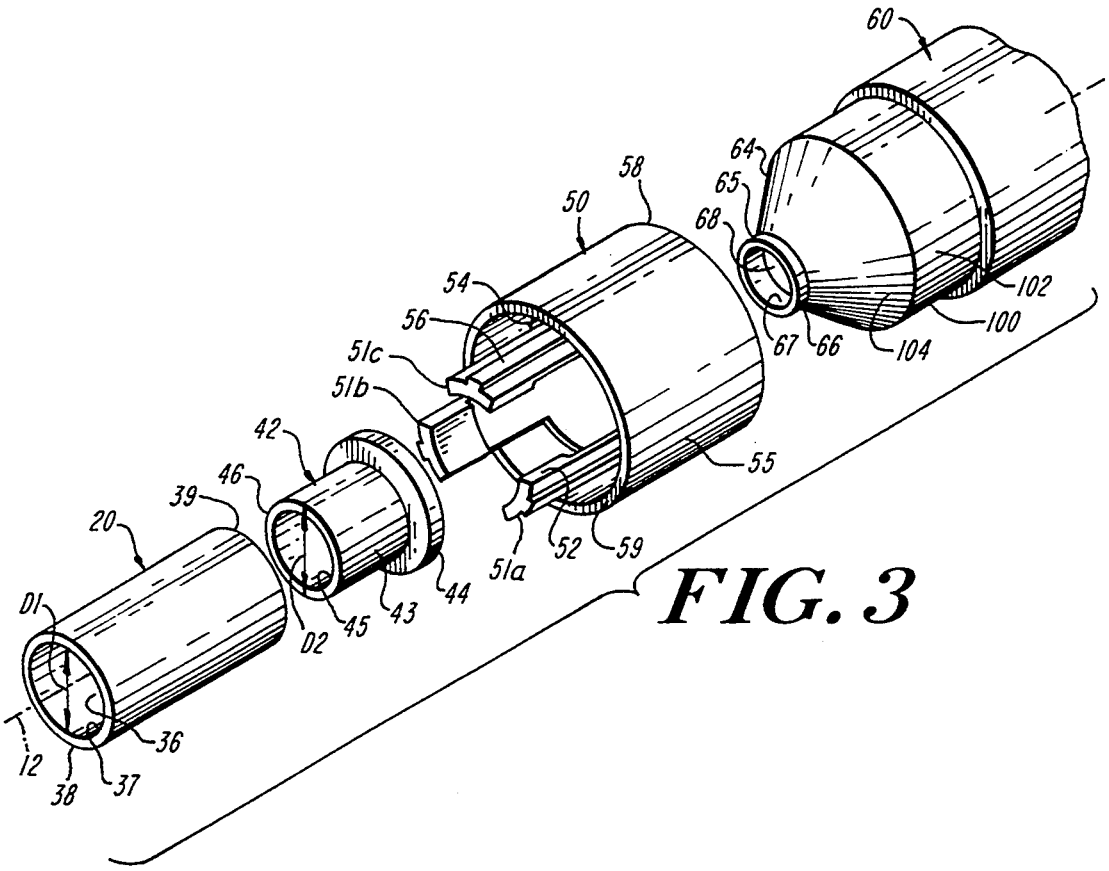
FIG. 3 is an exploded view of the nose cone assembly of the toy projectile according to a preferred embodiment of the invention.
Figure 4:
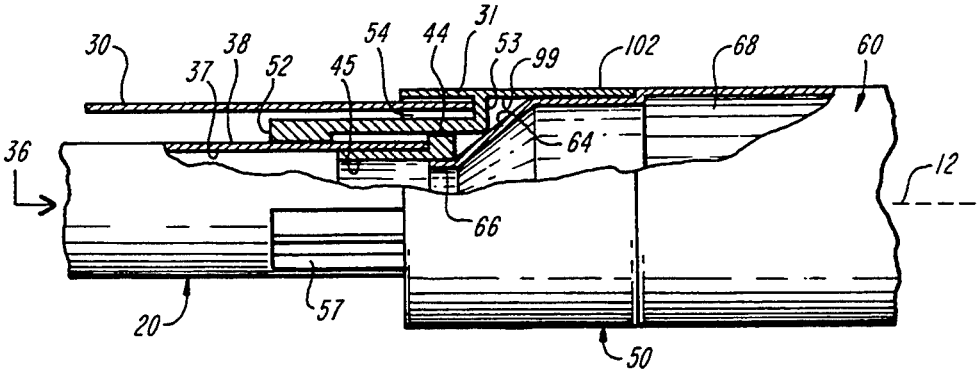
FIG. 4 is a partial cut-away side view of the nose cone assembly of FIG. 3 with a rotor blade disposed in a closed position.
Figure 5:
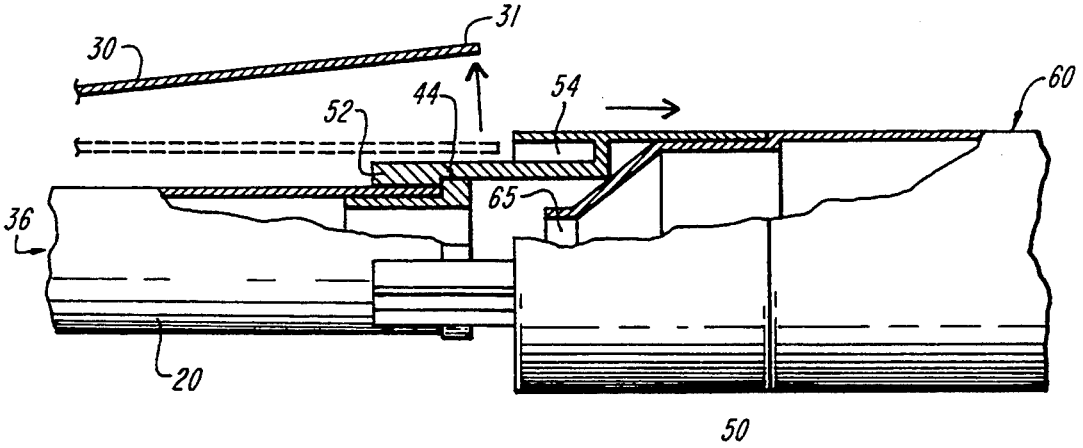
FIG. 5 is a partial cut-away side view of the nose cone assembly of FIG. 3 with a rotor blade disposed in an open position.

The illustrated practice of the invention includes, as shown in FIGS. 3, 4 and 5, a main body 20 having an inner surface 37 and an outer surface 38. The main body 20 has an inner diameter D1. An inner-lumen or passage 36 extends through the main body 20 along the longitudinal axis 12. Although shown as having a substantially tubular shape, those of ordinary skill will recognize that the main body 20 can have any geometric shape.

The slide stop element 42 has a tubular body portion 43 and an annular lip 44 formed at one end. The body portion 43 has an inner surface 45, an outer surface 46, and an outer diameter D2. The outer diameter D2 of the slide stop 42 is closely equal to but less than the main body inner diameter D1. The slide stop 42 can also have any geometric shape and, preferably, complements the shape of the main body 20.

The slide stop element 42 mounts within the main body 20 such that the slide stop outer surface 46 is placed in intimate facing contact with the main body inner surface 37. When the slide stop tubular portion 43 is fully seated within the main body 20, the slide stop lip 44 abuts the top of the main body 39, as shown in FIG. 4. In a preferred embodiment, the slide stop 42 is fixedly secured within the main body 20, as by applying an adhesive to the slide stop outer surface 43.

The external slide element 50 has a tubular body portion 55 having an inner surface 99. Three protrusions or legs 51a–c extend rearward from the body portion 55 along the longitudinal axis 12. The illustrated legs 51a–c are identical and corresponding parts thereof are designated with identical reference numerals. Each leg 51a–c has a ridge 56 radially projecting on the leg outer surface, as shown. A leg engagement 52 protrudes radially inward from the underside of each leg 51. The legs 51a–c are circumferentially and substantially evenly spaced apart about the body portion 55 of the external slide element 50.

As appears in FIG. 4, an inwardly extending annular extension 53 joins the legs 51a–c to the external slide body portion 55. The extension 53 is axially spaced from a rearward end 59 of the body portion 55 opposite a receiving portion 58. The extension 53 separates the legs 51a–c from the body portion 55, thereby defining an annular groove 54 that seats a blade tip 31 of the rotor blade 30. The illustrated legs 51a–c define a skeletal outer diameter closely equal to but larger than the diameter of the slide stop lip 44, and the leg engagements 52 form a skeletal inner diameter slightly larger than the outer diameter of the main body 20, but less than the diameter of the lip 44. This preferred arrangement allows the nose cone assembly 15 to move axially from the hold position 16 to the release position 17 while remaining assembled. Hence, the external slide element legs 51a–c and the slide stop lip 44 form a retaining mechanism that secures the nose cone assembly 15 to the main body 20. The operation of the assembly 15 and the arrangement of the rotor blades 30 and slide stop are discussed further below.

The nose cone 60 has a tapered top portion enclosed at one end (see FIG. 1), and a tapered bottom portion 64. The bottom portion 64 preferably includes a substantially flat and rearwardly extending flange portion 100 having an outer surface 102, and an integrally formed and rearwardly extending funnel-like portion 104. The bottom portion funnel-like portion 104 terminates in a circular opening 65 having an outer surface 66 and an inner surface 67. The nose cone 60 has a hollow interior forming a gas accumulation chamber 68, which is partially shown in FIG. 3. One skilled in the art will recognize that although the nose cone assembly 15 includes more than one component, the assembly 15 can be molded as a unitary piece.

The nose cone 60, external slide element 50 and slide stop 42 can be made from any material suitable for model structures, such as wood and aluminum, and are preferably made of plastic. The rocket main body 20 can also be made of wood, aluminum or plastic, but is preferably made of reinforced cardboard.

FIG. 4 shows the elements 20, 42, 50 and 60 assembled. The nose cone bottom portion 64 mounts within the receiving portion 58 of the external slide element 50, forming the nose cone assembly 15. When mounted therein, the flange outer surface 102 is placed in intimate facing contact with the external slide element inner surface 99. The nose cone assembly 15 coaxially seats over the main body 20 such that the leg engagements 52 contact with and are moveable along the main body outer surface 38, as shown. The outer surface 66 of the circular opening 65 seats in intimate facing contact with the slide stop inner surface 45 forming a substantially gas-tight seal. This overall configuration allows a gas, formed from the burning of the motor solid fuel propellant, to flow through the inner-lumen 36 and into the gas accumulation chamber 68.

With further reference to FIGS. 4 and 5, the nose cone assembly 15 moves axially between the hold position 16 and the release position 17. FIG. 4 shows the nose cone assembly 15 disposed in the hold position 16. The leg engagements 52 are axially spaced a selected distance from the slide stop lip 44. The hold position 16 disposes the annular groove 54 over the rotor blade tips 31, while simultaneously placing the circular opening 65 within the slide stop element opening. In a preferred embodiment, the selected distance the retaining assembly 15 moves along the axis 12 allows the annular groove 54 to release the rotor blades 30 into the open position B (see FIG. 2).

The burning of the motor fuel propellant mounted in the base 25 creates exhaust gases which flow through the inner-lumen 36 of the main body 20, and which accumulate within the gas accumulating chamber 68. The accumulated gases create an internal pressure within the nose cone 60. The pressure of the accumulating gases biases the assembly 15 along the longitudinal axis 12 (left to right in FIGS. 4 and 5). The nose cone assembly 15 moves axially, in response to the internal pressure, along the main body 20 until the leg engagements 52 abut the slide stop lip 44, as shown in FIG. 5.

The leg engagements 52 engage the nose cone assembly 15 to the main body 20, preventing the assembly 15 from separating from the main body 20. Although only three legs 51 are shown, any number of legs 51 can be employed to make the apparatus function equivalently. Those of ordinary skill in the art will realize that a continuous annular ring can be used in lieu of the external slide element legs 51. Further, the legs 51 can be evenly spaced about the circumference of the main body 20. However, it should be understood that the spacing between the legs may vary.

Referring to FIG. 5, when the nose cone assembly 15 is biased into the release position 17 (e.g., by accumulated exhaust gases), the circular opening 65 separates from the slide stop 42. Exhaust gas escapes from the inner-lumen 36 and gas chamber 68 and through the openings located between the external slide element legs 51, thereby reducing the model rocket internal pressure and preventing damage to the same.

Figure 6:
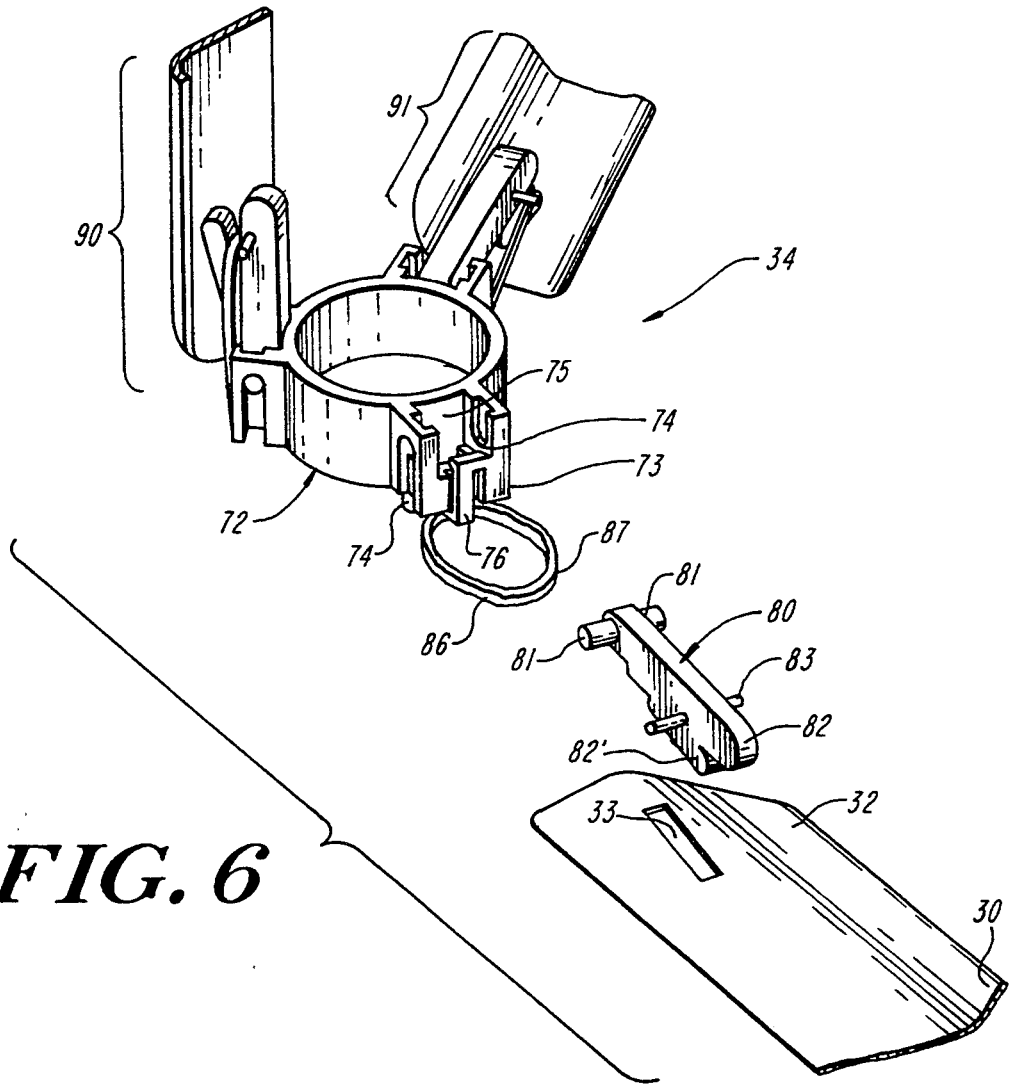
FIG. 6 is a plan view of a rotor hub assembly according to a preferred embodiment of the invention.

FIG. 6 illustrates the rotor hub assembly 34 according to a preferred embodiment of the invention. The rotor hub assembly 34 includes an annular rotor hub 72 having mounting portions 73 extending radially outward from the hub. A rotor mount 80, that supportingly mounts one blade 30, hingedly mounts to each mounting portion 73. The illustrated mounting portions 73 and rotor mounts 80 are identically configured and corresponding parts thereof have identical reference numerals. Each mounting portion 73 has a recessed receiving structure 75 and a set of vertical grooves 74. An L-shaped protrusion 76 extends radially outward from the front face of the mounting portion 73, and further extends axially downward and beneath the portion 73, forming an attachment (not shown) for a biasing element 86. The biasing element 86, illustrated as an elastic band, loops onto the attachment portion of the L-shaped protrusion 76.

Each illustrated rotor mount 80 includes a pair of opposed mounting pins 81 at a base end, and opposite thereto a pair of opposed blade-stabilizing pins 83. The frontward end of the mount 80 forms a flange portion having a beveled edge forming a set of protruding fingers 82, 82'.

The rotor mount 80 mountingly seats with the hub 72 within the recessed receiving portion 75 by mounting the pins 81 within a corresponding vertical groove 74, thereby forming a snap-fit assembly; see the completed assembly 90 also shown in FIG. 6. The mount 80 attaches to the rotor blade 30 by inserting one rotor mount finger 82' within a cut-away slot formed in the base end 32 of the rotor blade 30. The length of the rotor finger 82' corresponds to the length of the slot 33, thereby placing the rotor blade base end 32 in contact with the underside of the rotor mount 80 (assembly 90). This union places the top side of the rotor blade 30 in contact with the stabilizing pins 83. The stabilizing pins 83 enhances the strength of the snap-fit assembly of rotor mount 80 and rotor blade 30, especially during deployment of the rotor blades 30, for example, during flight where large aerodynamic forces apply pressure to the entire blade 30.

The biasing element free-end 87 loops over the rotor mount finger 82', creating a resilient biasing force capable of moving the rotor blades from the closed position A to the open position B. In a preferred embodiment of the invention, the model rocket 10 includes the biasing element 86 to help bias the rotor blades 30 into the open position B. However, those of ordinary skill will recognize that the biasing element is not essential to the operation of the gyro-rotating recovery system and can be omitted.

Inserting the rotor mount pins 81 within the rotor mount grooves 74 provides a hingedly mounted assembly, whereby the rotor blades 30 can be moved between the closed position A (see completed assembly 90) and the open position B (see completed assembly 91); FIGS. 1 and 2.

The rotor hub 72 and rotor mounts 80 can be formed from any model structured material, such as wood or aluminum, but are preferably made of plastic. The biasing element 86 is preferably made from any resilient material including coiled steel and aluminum, and most preferably from elasticized rubber.

In operation, the model rocket rotor blades 30 are folded into the closed position A and the rotor blade tips 31 are inserted into the annular groove 54. The rotor blades 30 are maintained in this closed position by the retaining assembly 15 when disposed in the hold position 16. The rocket motor mounted within the tail assembly 25 is then ignited by any suitable means, such as an electric igniter, and the model rocket 10 is propelled into the air. The burning of the motor solid fuel propellant causes exhaust gases to flow through the rocket body inner-lumen 36, and into the nose cone gas chamber 68. When the gases in the chamber 68 accumulate to a predetermined level, the internal pressure causes the nose cone assembly 15 to move from the hold position 16 to the release position 17. The rotor blades 30, no longer restrained by the annular groove 54, are biased into the open position by the biasing element 86. During the rocket's descent, the air pressure on the blades 30 causes the rotor hub assembly 34 to rotate about the main body 20. The rotation of the rotor blades 30 simulates a helicopter or gyro-rotating effect, thus assuring the slow, gentle descent of the rocket.

The nose cone assembly 15 can be moved between the hold and release positions 16,17 by the gas pressure within the nose cone 60, or by gravity acting upon the nose cone assembly 15, for example, during the rocket's descent. Further, the rotor blades 30 can be released either during ascent, during apogee (point of maximum height), or during descent.

In one mode of operation, the rotor blades 30 are prematurely released while the rocket is still ascending. During this mode, the blades 30 are easily biased into the deployed position by the air flowing over the blades, created by the forward propulsion of the rocket. The biasing element 86 thus functions as a redundant deployment mechanism, further ensuring that the rocket blades 30 are biased into the deployed position. The aerodynamic drag created by the deployed blades 30 causes the rocket to slow, until it reaches apogee, and then finally starts to descend. During descent, air flowing over the rotor blades 30 creates a force perpendicular to the length of the rotor blades 30. Since the rotor hub 72 rotates freely about the rocket main body 20, the rotor hub assembly 34 rotates, creating a gyro-rotating effect.

In another mode of operation, the rotor blades 30 deploy when the rocket 10 reaches apogee (normal operation). At this point, when there is no aerodynamic force to deploy the blades 30 into the open position 30, the biasing element 86 provides the necessary force. Additionally, the heavier nose end of the rocket due to the mass of the rocket main body and the nose cone assembly disposed forward of the rotor hub generates creates mechanical forces that swing the rocket and thus the blades 30 into the proper (downward) orientation for descent.

In still another mode of operation, the nose cone assembly 15 remains in the hold position 16 after the rocket reaches apogee. As the rocket starts to descend, the forward center of gravity of the rocket 10, as well as the accumulation of gas in the nose cone chamber 68, causes the nose cone assembly to move axially from the hold position 16 to the release position 17 (as depicted in FIG. 2), and the aerodynamic drag on the rotor blades 30 deploys the blades.

In accordance with the above description, the invention attains the objects set forth. It is further intended that the description and drawings be interpreted as illustrative and not in a limiting sense. While various embodiments of the invention have been described in detail, other alterations obvious to those skilled in the art are intended to be embraced by the spirit and scope of the invention. The invention is to be defined, therefore, not by the preceding detailed description but by the claims that follow.

What is claimed as new and desired to be secured by Letters Patent is:

1. Recoverable aerial toy apparatus having a gyro-rotating recovery system, said apparatus having a main body extending along a longitudinal axis between front and back ends and removably and replaceably mounting a fuel propellant and further comprising A. rotor hub means mounted on said main body at a location distal from said front end and rotatable relative thereto about said axis, B. a plurality of rotor blades, each hingedly coupled to said hub means for rotation therewith about said axis and for hinged movement relative thereto between a closed position and an open position, said rotor blades extending along said longitudinal axis when disposed in said closed position and extending radially relative to said axis and outward from said body when disposed in said open position, C. releasable retaining means, mounted on said front end of said main body and movable relative thereto between a hold position and a release position, for selectively holding said rotor blades in said closed position when said retaining means is disposed in said hold position and tier releasing said blades into said open position when said retaining means is disposed in said release position, said retaining means including means for the release of gas from within said main body when in said release position and not when in said hold position, and D. engagement means for maintaining said releasable retaining means assembled with said main body in both said hold position and said release position.

2. Aerial toy apparatus according to claim 1 further comprising biasing means for biasing said rotor blades into said open position.

3. Aerial toy apparatus according to claim 1 wherein said releasable retaining means further includes A. sliding means for selectively holding said blades in said closed position when said sliding means is disposed in said hold position, and for releasing said blades into said open position when said retaining means is disposed in said release position, and B. actuating means coupled to said sliding means for moving said sliding means from said hold position to said release position.

4. Aerial toy apparatus according to claim 3 wherein said actuating means moves by mechanical forces acting upon a portion of said rocket generally at said rocket's apogee point.

5. Aerial toy apparatus according to claim 3 wherein said actuating means moves by means of gas pressure.

6. Aerial toy apparatus according to claim 3 wherein said sliding means includes an external slide element.

7. Aerial toy apparatus according to claim 3 wherein said actuating means includes a nose cone.

8. Aerial toy apparatus according to claim 3 wherein said releasable retaining means moves axially between said hold position and said release position.

9. Aerial toy apparatus according to claim 1 wherein said engagement means comprises a slide stop element.

10. Aerial toy apparatus according to claim 1 wherein said rotor hub means comprises (i) a rotor hub, and (ii) a plurality of rotor mounts hingedly mounted to said rotor hub, and each of which has a blade-receiving portion for removably and replaceably securing said rotor blades thereto.

11. In a toy projectile including a hollow tubular body fuselage extending along a longitudinal axis, a nose cone assembly, and a base having body fins, the improvement comprising A. a rotor hub mounted proximal to said base on said body fuselage and rotatable relative thereto about said axis, B. a plurality of rotor blade assemblies hingedly mounted to said rotor hub and including (i) a plurality of rotor blades alternately disposable between a closed position and an open position wherein each of said rotor blades extends substantially along said longitudinal axis of said shaft in said closed position and each of said rotor blades extends substantially radially relative to said axis and outward from said body when disposed in said open position, and (ii) a plurality of rotor mounts hingedly mounted to said rotor hub and having a blade receiving end for removably and replaceably securing said rotor blades thereto, and C. sliding means assembled with said body fuselage and axially slidable thereon, for holding said rotor blades in said closed position when said sliding means is disposed in a hold position, and releasing said blades into said open position when said sliding means is disposed in a release position, said sliding means including means for releasing gas from within said body fuselage only when in said release position, whereby said toy projectile remains assembled during flight of said projectile.

12. Recoverable aerial toy apparatus having a gyro-rotating recovery system, said apparatus having a main body extending along a longitudinal axis between front and back ends and removably and replaceably mounting a fuel propellant and further comprising A. rotor hub means mounted on said main body at a location distal from said front end and rotatable relative thereto about said axis, B. a plurality of rotor blades, each hingedly coupled to said hub means for rotation therewith about said axis and for hinged movement relative thereto between a closed position and an open position, said rotor blades extending along said longitudinal axis when disposed in said closed position and extending radially relative to said axis and outward from said body when disposed in said open position, C. releasable retaining means, mounted on said forward nose end of said main body and movable relative thereto between a hold position and a release position, for selectively holding said rotor blades in said closed position when said retaining means is disposed in said hold position and for releasing said blades into said open position when said retaining means is disposed in said release position, D. engagement means for engaging said releasable retaining means to said main body, and E. pressure control means for releasing a gas generated by said fuel propellant when said releasable retaining means is in the release position and for containing said gas when said releasable retaining means is in the hold position, said pressure control means connected to said main body in both said hold and said release positions with a sliding element.

* * * * *